US009494152B2

(12) United States Patent
Saga

(10) Patent No.: US 9,494,152 B2
(45) **Date of Patent: *Nov. 15, 2016**

(54) VARIABLE VANE DISPLACEMENT PUMP UTILIZING A CONTROL VALVE AND A SWITCHING VALVE

(71) Applicant: HITACHI AUTOMOTIVE SYSTEMS, LTD., Hitachinaka-shi, Ibaraki (JP)

(72) Inventor: Koji Saga, Ebina (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 74 days.

This patent is subject to a terminal disclaimer.

(21) Appl. No.: 14/073,347

(22) Filed: Nov. 6, 2013

(65) Prior Publication Data

US 2014/0147322 A1 May 29, 2014

(30) Foreign Application Priority Data

Nov. 27, 2012 (JP) ..... 2012-258826

(51) Int. Cl.
*F04C 14/22* (2006.01)
*F04C 2/344* (2006.01)

(52) U.S. Cl.
CPC ..... *F04C 14/226* (2013.01); *F04C 2/344* (2013.01); *F04C 2210/206* (2013.01); *F04C 2270/18* (2013.01)

(58) Field of Classification Search
CPC ..... F04C 14/226; F04C 2270/18; F04C 2/344; F04C 2270/185; F04C 2/3442
See application file for complete search history.

(56) References Cited

U.S. PATENT DOCUMENTS 5,518,380 A * 5/1996 Fujii et al. ..... 418/26
6,530,752 B2 * 3/2003 Oba et al. ..... 418/30
(Continued)

FOREIGN PATENT DOCUMENTS

EP 2 253 847 A1 11/2010
JP 59-70891 A 4/1984
(Continued)

OTHER PUBLICATIONS

Watanabe et al., Non-Final Office Action dated Aug. 28, 2015 issued in corresponding U.S. Appl. No. 13/852,636.
(Continued)

*Primary Examiner* — Mary A Davis
(74) *Attorney, Agent, or Firm* — Foley & Lardner LLP

(57) ABSTRACT

A variable displacement pump includes: a control mechanism arranged to be actuated based on a hydraulic pressure introduced into the introduction passage before the eccentric amount is minimized, and arranged to introduce the hydraulic pressure through a throttling to the second control hydraulic chamber when the hydraulic pressure introduced from the introduction passage is equal to or smaller than a predetermined pressure, and to discharge the hydraulic fluid within the second control hydraulic chamber in accordance with the hydraulic pressure when the hydraulic pressure introduced from the introduction passage becomes greater than the predetermined pressure; and a switching mechanism arranged to switch between a state in which the hydraulic fluid introduced into the introduction passage is introduced to the control mechanism, and a state in which the hydraulic fluid introduced into the introduction passage is discharged from the control mechanism.

8 Claims, 7 Drawing Sheets

(56) References Cited

U.S. PATENT DOCUMENTS

| | | | | |
|---|---|---|---|---|
| 6,672,844 | B2 | 1/2004 | Fukanuma et al. | |
| 8,684,702 | B2 * | 4/2014 | Watanabe et al. | 418/26 |
| 9,109,596 | B2 | 8/2015 | Ohnishi et al. | |
| 2008/0308062 | A1 | 12/2008 | Morita et al. | |
| 2009/0022612 | A1 | 1/2009 | Williamson et al. | |
| 2010/0028171 | A1 | 2/2010 | Shulver et al. | |
| 2010/0205952 | A1 | 8/2010 | Yamamuro et al. | |
| 2010/0329912 | A1 | 12/2010 | Williamson et al. | |
| 2011/0085921 | A1 | 4/2011 | Kato et al. | |
| 2011/0123379 | A1 | 5/2011 | Saga et al. | |
| 2011/0194967 | A1 * | 8/2011 | Watanabe et al. | 418/138 |
| 2012/0213655 | A1 * | 8/2012 | Ohnishi et al. | 418/24 |
| 2013/0089446 | A1 | 4/2013 | Williamson et al. | |
| 2013/0164163 | A1 * | 6/2013 | Ohnishi et al. | 418/27 |
| 2013/0195705 | A1 | 8/2013 | Williamson et al. | |
| 2014/0072456 | A1 * | 3/2014 | Watanabe et al. | 417/218 |
| 2014/0072458 | A1 * | 3/2014 | Watanabe | 417/290 |
| 2014/0119969 | A1 | 5/2014 | Iijima | |
| 2014/0219847 | A1 | 8/2014 | Watanabe et al. | |
| 2015/0020759 | A1 * | 1/2015 | Watanabe et al. | 123/90.15 |
| 2015/0218983 | A1 * | 8/2015 | Watanabe et al. | 418/24 |

FOREIGN PATENT DOCUMENTS

| | | | |
|---|---|---|---|
| JP | 2004-218529 | A | 8/2004 |
| JP | 2008-524500 | | 7/2008 |
| JP | 2011-080430 | A | 4/2011 |
| WO | WO-2012/113437 | A1 | 8/2012 |

OTHER PUBLICATIONS

Watanabe et al., Non-Final Office Action dated Aug. 31, 2015 issued in corresponding U.S. Appl. No. 14/073,357.

US Notice of Allowance on U.S. Appl. No. 14/073,357 dated Jun. 29, 2016.

Watanabe: US Notice of Allowance on U.S. Appl. No. 13/852,636 dated Mar. 24, 2016.

Watanabe: US Office Action on U.S. Appl. No. 13/974,686 dated Mar. 24, 2016.

* cited by examiner

VARIABLE VANE DISPLACEMENT PUMP UTILIZING A CONTROL VALVE AND A SWITCHING VALVE

BACKGROUND OF THE INVENTION

This invention relates to a variable displacement pump which is employed as a hydraulic source arranged to supply a hydraulic fluid to sliding portions and so on of an internal combustion engine of a vehicle.

A Japanese Patent Application Publication No. 2008-524500 (corresponding to U.S. Patent Application Publication No. 2009/022612 A1, U.S. Patent Application Publication No. 2010/329912 A1, U.S. Patent Application Publication No. 2013/098446 A1, and U.S. Patent Application Publication No. 2013/195705 A1) discloses a variable displacement pump which is a vane type variable displacement oil pump that is used for an internal combustion engine of a vehicle. In this variable displacement oil pump, an eccentric amount of the cam ring is controlled in a two stepped (stepwise) manner by an urging force based on discharge pressures which are introduced into two control hydraulic chambers that are separated between a pump housing and a cam ring, and which are acted in a direction (hereinafter, referred to as concentric direction) in which the eccentric amount of the cam ring with respect to a center of a rotation of a rotor becomes small, and by a spring force of a spring arranged to urge the cam ring in a direction (hereinafter, referred to as an eccentric direction) in which the eccentric amount of the cam ring becomes large. With this, it is possible to supply the oil to a plurality of devices having different necessary discharge pressures.

In particular, when the engine speed is increased, the discharge pressure is introduced into one of the control hydraulic chambers. When the discharge pressure reaches a first predetermined hydraulic pressure which is a first equilibrium pressure, the cam ring is slightly moved in the concentric direction against the spring force of the spring. Then, when the engine speed is further increased, the discharge pressure is also introduced into the other of the control hydraulic chambers, in addition to the one of the control hydraulic chambers. When the discharge pressure reaches a second predetermined hydraulic pressure which is a second equilibrium pressure, the cam ring is further moved in the concentric direction against the spring force of the spring. In this way, the two stepped control is performed.

SUMMARY OF THE INVENTION

However, in the case of the above-described conventional displacement pump, it is necessary that the cam ring is urged by using the spring having a relatively large spring constant which can counterbalance the internal pressures of the two control hydraulic chambers. Accordingly, the cam ring may be difficult to be moved in accordance with the increase of the discharge pressure. Consequently, in particular, when the pressure is held to the second predetermined hydraulic pressure in a relatively high engine speed region, the discharge pressure is largely increased in accordance with the increase of the engine speed (the pump rotational speed). Consequently, there is a problem that the necessary discharge pressure characteristic is not sufficiently ensured.

It is, therefore, an object of the present invention to provide a variable displacement pump devised to solve the above-described problems, and to maintain a desired discharge pressure with respect to a request for maintaining to the desired hydraulic pressure, by suppressing an increase of a discharge pressure even when an engine speed is increased.

According to one aspect of the present invention, a variable displacement pump comprises: a rotor rotationally driven; a plurality of vanes which are provided on an outer circumference side of the rotor to be projectable from and retractable into the rotor; a cam ring which receives the rotor and the plurality of vanes therein to separate a plurality of hydraulic fluid chambers, and which is arranged to be moved so as to vary an eccentric amount of a center of an inner circumference of the cam ring with respect to a center of the rotation of the rotor, and thereby to vary increase amounts or decrease amounts of volumes of the hydraulic fluid chambers at the rotation of the rotor; side walls disposed on both sides of the cam ring in the axial direction, at least one of the side walls including a suction portion opened in the hydraulic fluid chambers whose volumes are increased in the eccentric state of the cam ring, and a discharge portion opened in the hydraulic fluid chambers whose volumes are decreased in the eccentric state of the cam ring; an urging member which is provided to have a set load, and which is arranged to urge the cam ring in a direction in which the eccentric amount of the cam ring is increased; a first control hydraulic chamber to which a hydraulic fluid discharged from the discharge portion is constantly introduced, and which is arranged to act an urging force to the cam ring in a direction in which the eccentric amount is decreased, by an internal pressure of the first control hydraulic chamber; a second control hydraulic chamber to which the hydraulic fluid is introduced from the discharge portion through an introduction passage, and which is arranged to act an urging force to the cam ring in the direction in which the eccentric amount is increased, by an internal pressure of the second control hydraulic chamber, the urging force of the second control hydraulic chamber being smaller than the first urging force of the control hydraulic chamber; a control mechanism which is arranged to be actuated based on a hydraulic pressure introduced into the introduction passage before the eccentric amount is minimized, and which is arranged to introduce the hydraulic pressure through a throttling to the second control hydraulic chamber when the hydraulic pressure introduced from the introduction passage is equal to or smaller than a predetermined pressure, and to discharge the hydraulic fluid within the second control hydraulic chamber in accordance with the hydraulic pressure when the hydraulic pressure introduced from the introduction passage becomes greater than the predetermined pressure; and a switching mechanism arranged to switch between a state in which the hydraulic fluid introduced into the introduction passage is introduced to the control mechanism, and a state in which the hydraulic fluid introduced into the introduction passage is discharged from the control mechanism.

According to another aspect of the invention, a variable displacement pump comprises: a rotor rotationally driven; a plurality of vanes which are provided on an outer circumference side of the rotor to be projectable from and retractable into the rotor; a cam ring which receives the rotor and the plurality of vanes therein to separate a plurality of hydraulic fluid chambers, and which is arranged to be moved so as to vary an eccentric amount of a center of an inner circumference of the cam ring with respect to a center of the rotation of the rotor, and thereby to vary increase amounts or decrease amounts of volumes of the hydraulic fluid chambers at the rotation of the rotor; side walls disposed on both sides of the cam ring in the axial direction, at least one of the side walls including a suction portion opened in the hydraulic fluid chambers whose volumes are increased in the eccentric state of the cam ring, and a discharge portion opened in the hydraulic fluid chambers whose volumes are decreased in the eccentric state of the cam ring; an urging member which is provided to have a set load, and which is arranged to urge the cam ring in a direction in which the eccentric amount of the cam ring is increased; a first control hydraulic chamber to which a hydraulic fluid discharged from the discharge portion is constantly introduced, and which is arranged to act an urging force to the cam ring in a direction in which the eccentric amount is decreased, by an internal pressure of the first control hydraulic chamber; a second control hydraulic chamber to which the hydraulic fluid is introduced from the discharge portion through an introduction passage, and which is arranged to act an urging force to the cam ring in the direction in which the eccentric amount is increased, by an internal pressure of the second control hydraulic chamber, the urging force of the second control hydraulic chamber being smaller than the first urging force of the control hydraulic chamber; a switching mechanism including; a switching valve body including an upstream side opening portion which is opened in an axial one end portion of the switching valve body, and which is connected to an upstream portion of the introduction passage, a downstream side opening portion which is connected to a downstream portion of the introduction passage, and a switching drain opening portion connected to a drain, a valve element which is received within the switching valve body to be slid in an axial direction, and which is arranged to switch a connection state between the upstream side opening portion, the downstream side opening portion and the switching drain opening portion, by the axial sliding movement, and a solenoid which is arranged to push the valve element toward the upstream side opening portion by being applied with an current, and thereby to close the upstream side opening portion; and a control mechanism including; a control valve body including an introduction passage opening portion which is opened in an first axial end portion of the control valve body, a control drain opening portion connected to the drain, and a control hydraulic chamber opening portion connected to the second control hydraulic chamber, a spool which is slidably received within the first axial end portion of the control valve body, and which is arranged to switch a connection state between the introduction passage opening portion, the control drain opening portion, and the control hydraulic chamber opening portion in accordance with an axial position of the spool, and an urging member which is received within the second axial end portion of the control valve body, and which is arranged to urge the spool toward the first axial end portion of the control valve body.

According to still another aspect of the invention, a variable displacement pump comprises: a pump constituting section which is arranged to vary volumes of a plurality of hydraulic fluid chambers in accordance with a rotation, and which is arranged to be rotationally driven, and thereby to discharge a hydraulic fluid introduced from a suction portion to a discharge portion; a variable mechanism which is arranged to vary variation amounts of the volumes of the hydraulic fluid chambers opened to the discharge portion by moving a movable member; an urging member which is provided to have a set load, and which is arranged to urge the movable member in a direction in which the variation amounts of the volumes of the hydraulic fluid chambers opened to the discharge portion is increased; a first control hydraulic chamber to which the hydraulic fluid discharged from the discharge portion is introduced, and which is arranged to act an urging force to the movable member in a direction which is opposite to the direction of the urging force of the urging member, based on an internal pressure of the first control hydraulic chamber; a second control hydraulic chamber to which the hydraulic pressure is introduced through a throttling from an introduction passage connected to the discharge portion, and which is arranged to act an urging force to the movable member in a direction identical to the direction of the urging force of the urging member, based on an internal pressure of the second control hydraulic chamber; a control mechanism which is arranged to be actuated based on the hydraulic pressure introduced into the introduction passage before the variation amounts of the volumes of the hydraulic fluid chambers becomes minimum by the variable mechanism, and which is arranged to introduce the hydraulic pressure through the throttling to the second control hydraulic chamber when the hydraulic pressure introduced from the introduction passage is equal to or smaller than a predetermined pressure, and to discharge the hydraulic fluid within the second control hydraulic chamber in accordance with the hydraulic pressure when the hydraulic pressure introduced from the introduction passage becomes greater than the predetermined pressure; and a switching mechanism arranged to switch a state in which the hydraulic fluid introduced into the introduction passage is introduced to the control mechanism, and a state in which the hydraulic fluid introduced into the introduced passage is discharged from the control mechanism.

BRIEF DESCRIPTION OF THE DRAWINGS

FIG. 9A shows a state in a section a of FIG. 8. FIG. 9B shows a state in a section b of FIG. 8.

FIG. 10A shows a state in a timing c of FIG. 8. FIG. 10B shows a state in a section d of FIG. 8.

DETAILED DESCRIPTION OF THE INVENTION

Figure 1:
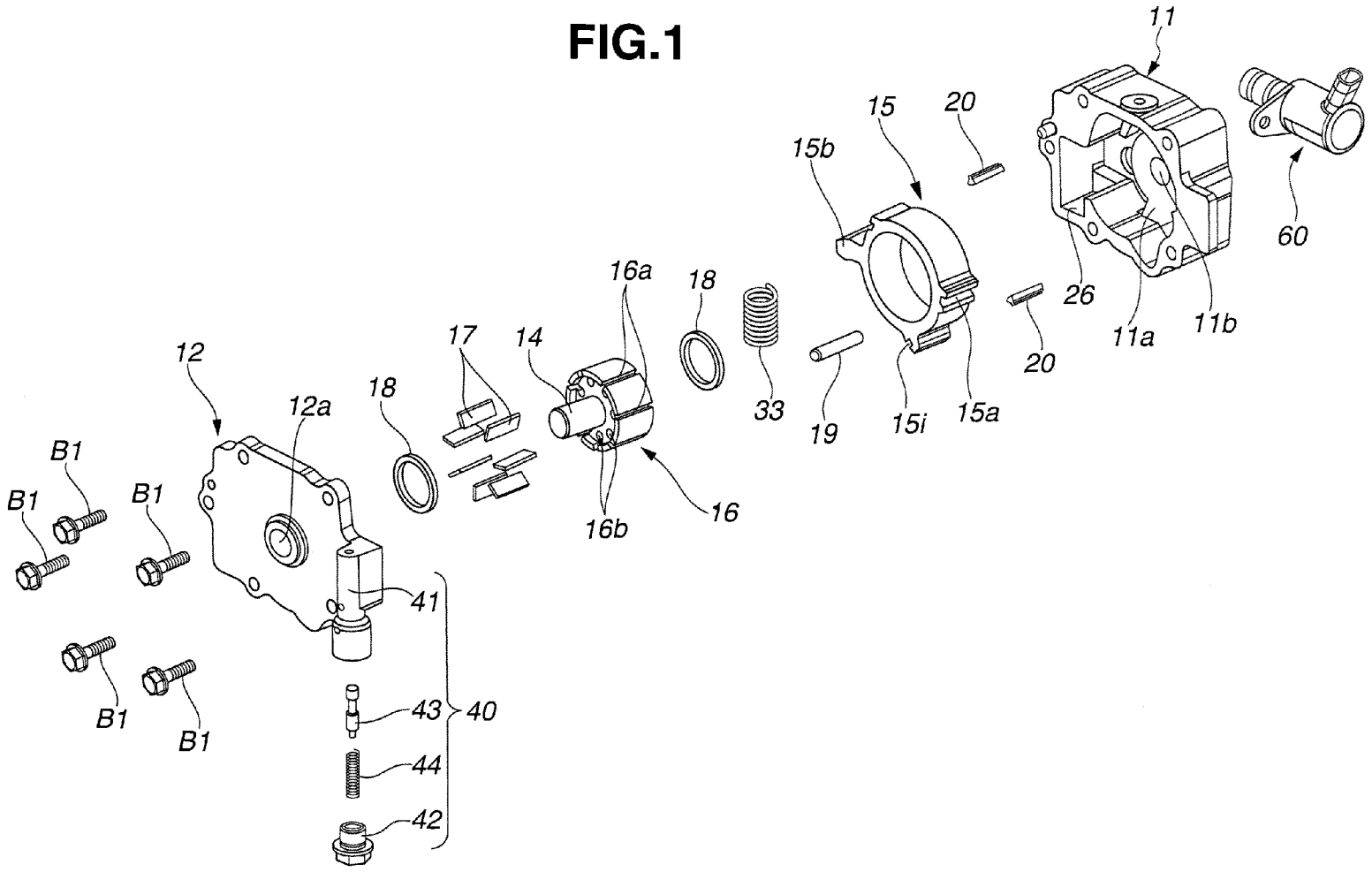
FIG. 1 is an exploded perspective view showing a variable displacement pump according to an embodiment of the present invention.
Figure 2:
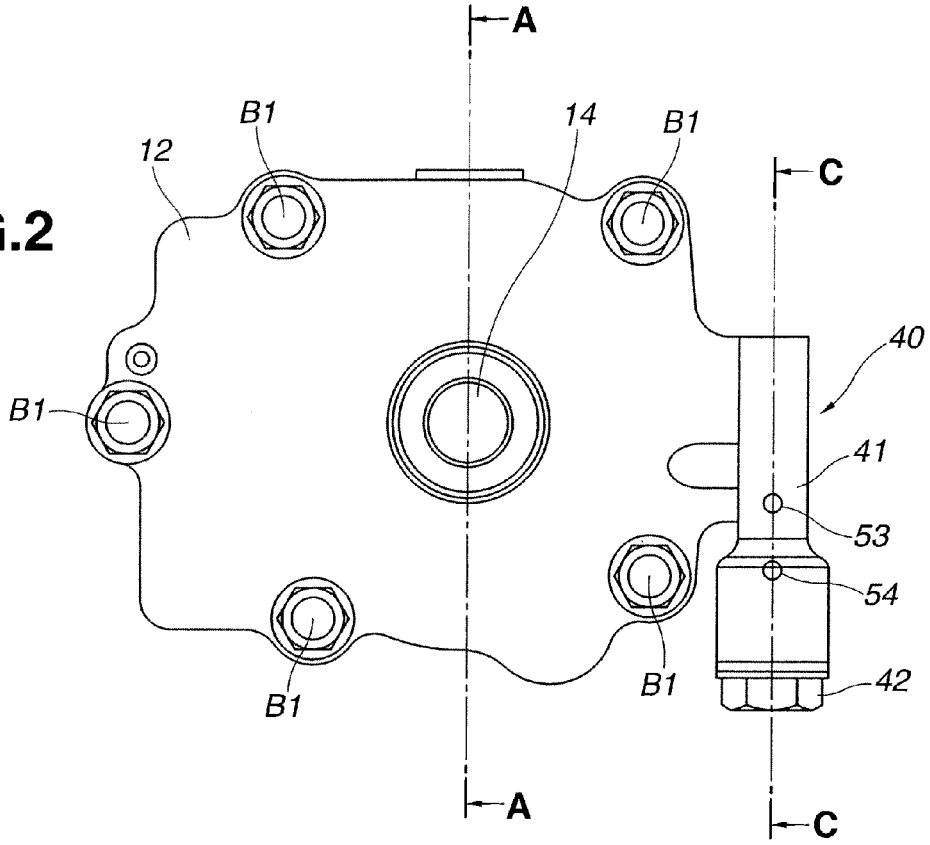
FIG. 2 is a front view showing the variable displacement pump of FIG. 1.

Hereinafter, a variable displacement pump according to one embodiment of the present invention is illustrated with reference to the drawings. In the below-described embodiment, the variable displacement pump according to the embodiment of the present invention is applied as an oil pump arranged to supply a lubricating oil of an internal combustion engine, to sliding portions of the engine for a vehicle, and a valve timing control apparatus arranged to control opening and closing timings of engine valves.

This oil pump 10 is provided to one end portion of one of a balancer apparatus and a cylinder block (not shown) of the internal combustion engine. As shown in FIG. 1 to FIG. 4, oil pump 10 includes a pump housing which includes a pump body 11 which has a substantially U-shaped longitudinal cross section, which has an opened one end side, and which includes a pump receiving chamber 13 formed therein, and a cover member 12 closing the open one end side of pump body 11; a drive shaft 14 which is rotationally supported by the pump housing, which penetrates through a substantially central portion of pump receiving chamber 13, and which is arranged to be rotationally driven by a crank shaft (not shown) or a balancer shaft (not shown), and so on; a cam ring 15 which is a movable member movably (swingably) received within pump receiving chamber 13, and which constitutes a variable mechanism arranged to vary variation amounts of volumes of pump chambers PR (described later) by cooperating with control hydraulic chambers 31 and 32, and a coil spring 33 (described later); and a pump constituting (forming) section which is received radially inside cam ring 15, and which is arranged to be rotationally driven by drive shaft 14 in a clockwise direction of FIG. 4, and thereby to increase or decrease the volumes of pump chambers PR which are a plurality of hydraulic fluid chambers formed between rotor 16 and cam ring 15, so as to perform a pump operation; and a pilot valve 40 which is fixed on the pump housing (cover member 12), and which is a control mechanism arranged to control a supply and a discharge of the hydraulic pressure to and from a second control hydraulic chamber 32 (described later); and a solenoid valve 60 which is provided on a hydraulic passage (a second introduction passage 72 described later) which is formed between pilot valve 40 and a discharge opening 22*b* (described later), and which is a switching mechanism arranged to control to switch a supply (introduction) of the discharge oil to the pilot valve 40's side.

In this case, the pump constituting section includes a rotor 16 which is rotationally received radially inside cam ring 15, and which includes a central portion connected to an outer circumference of drive shaft 14; vanes 17 which are received within a plurality of slits 16*a* formed by cutting in an outer circumference portion of rotor 16 to extend in the radial directions, and which are arranged to be projectable from and retractable in the rotor 16; and a pair of ring members 18 and 18 which have diameters smaller than a diameter of rotor 16, and which are disposed on side portions of rotor 16, on the inner circumference sides of rotor 16.

Pump body 11 is integrally formed from aluminum alloy. Pump body 11 includes an end wall 11*a* which constitutes one end wall of pump receiving chamber 13; and a bearing hole 11*b* which is formed at a substantially central portion of end wall 11*a* to penetrate through end wall 11*a*, and which rotationally supports one end portion of drive shaft 14. Furthermore, pump body 11 includes a support groove 11*c* which has a substantially semi-circular cross section, which is formed by cutting on an inner circumference wall of pump receiving chamber 13 at a predetermined position, and which swingably supports cam ring 15 through a rod-shaped pivot pin 19. Moreover, pump body 11 includes a seal sliding surface 11*d* which is formed on the inner circumference wall of pump receiving chamber 13 on an upper half side in FIG. 4 with respect to a line (hereinafter, referred to as a cam ring reference line) connecting a center of bearing hole 11*b* and a center of support groove 11*c*, and on which a seal member 20 disposed in an outer circumference portion of cam ring 15 is slidably abutted. This seal sliding surface 11*d* is an arc surface shape which is formed around a center of support groove 11*c* by a predetermined radius R1. Moreover, this seal sliding surface lid has a circumferential length set so that seal member 20 can be constantly slidably abutted on this seal sliding surface 11*d* in a range in which cam ring 15 is eccentrically swung. Similarly, pump body 11 includes a seal sliding surface 11*e* which is formed on a lower half side of FIG. 4 with respect to cam ring reference line M, and on which a seal member 20 disposed in the outer circumference portion of cam ring 15 is slidably abutted. This seal sliding surface 11*e* has an arc surface shape which is formed around the center of support groove 11*c* by a predetermined radius R2. This seal sliding surface 11*e* has a circumference length set so that seal member 20 can be constantly slidably abutted on this seal sliding surface 11*e* in the range in which cam ring 15 is eccentrically swung.

Figure 4:
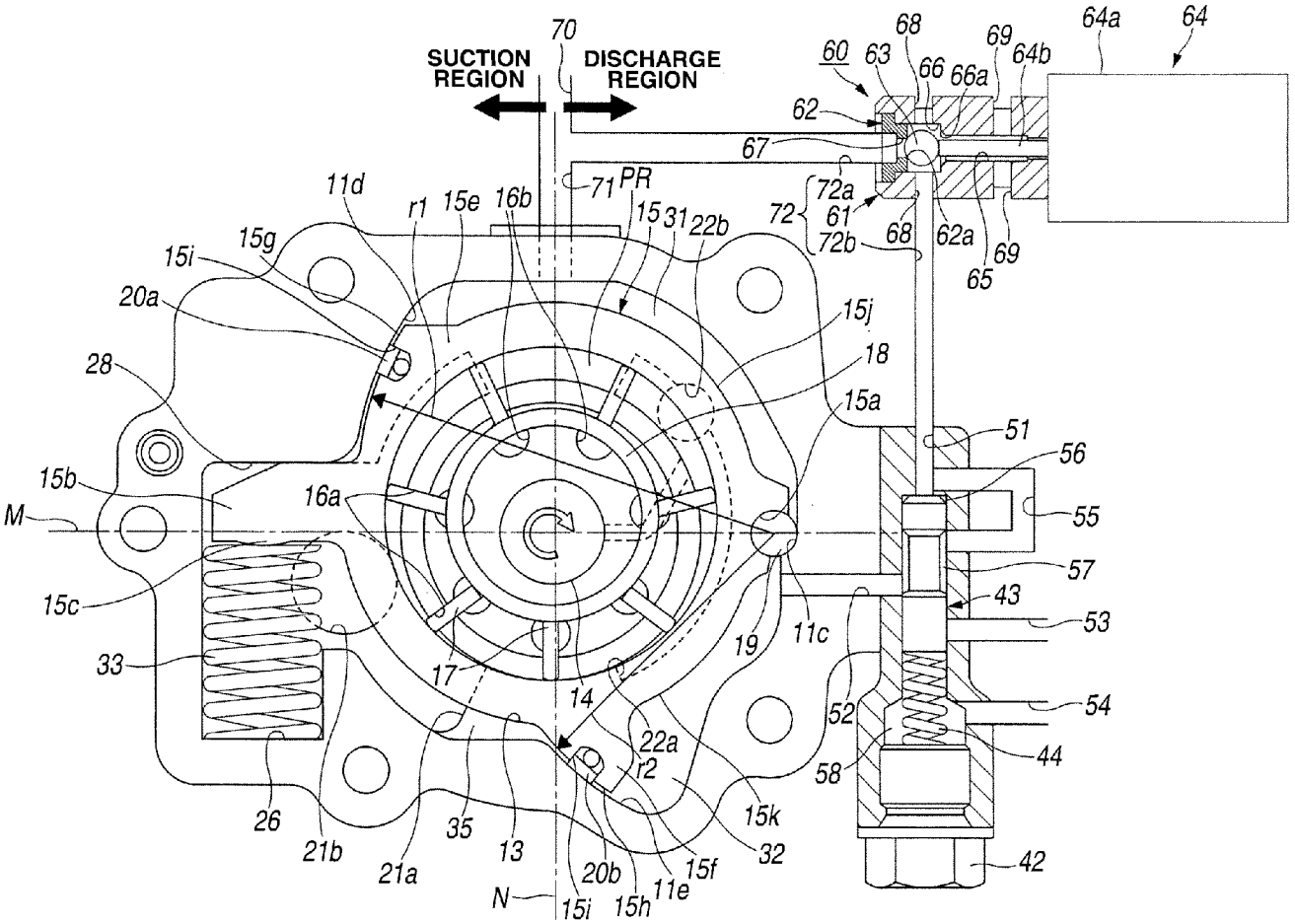
FIG. 4 is a sectional view taken along a section line B-B of FIG. 3.
Figure 5:
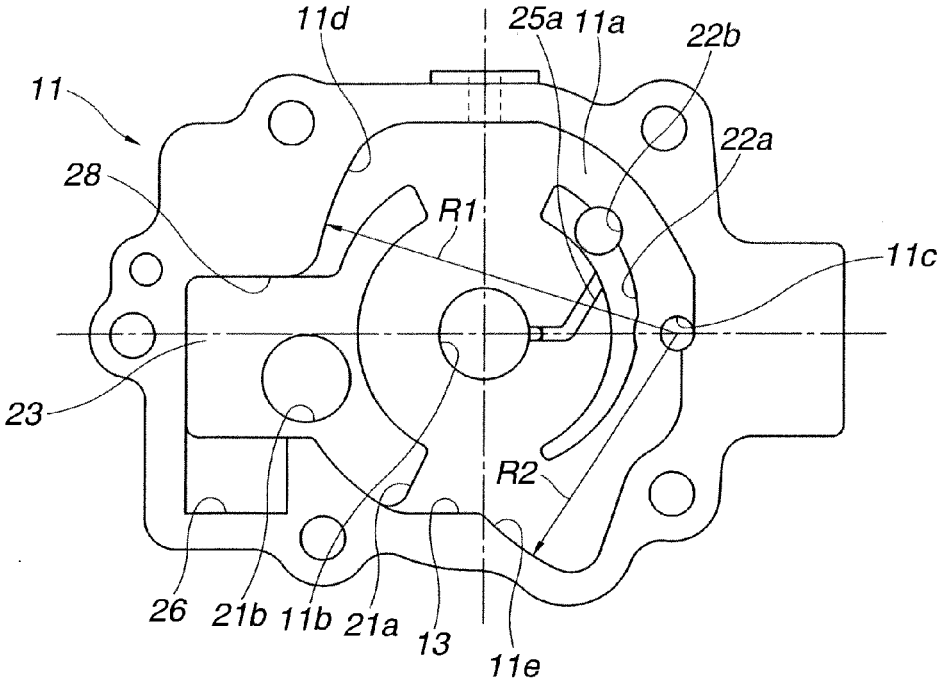
FIG. 5 is a view showing a pump body as viewed from a combined surface between the pump body and a cover member.

As shown in FIG. 4 and FIG. 5, pump body 11 includes a suction port 21*a* which is formed by cutting on the inner side surface of end wall 11*a* of pump body 11 radially outside bearing hole 11*b*, and which is a suction portion that is a substantially arc recessed shape, and that is opened in a region (a suction region) in which the volumes of pump chambers PR are increased in accordance with the pump operation of the pump constituting section. Moreover, pump body 11 includes a discharge port 22*a* which is formed by cutting on the inner side surface of end wall 11*a* of pump body 11 radially outside bearing hole 11*b*, and which is a discharge portion that is a substantially arc recessed shape, and that is opened in a region (a discharge region) in which the volumes of pump chambers PR are decreased in accordance with the pump operation of the pump constituting section. Suction port 21*a* and discharge port 22*a* are disposed to sandwich bearing hole 11*b* to substantially confront each other.

Suction port 21*a* includes an introduction portion 23 which is integrally formed at a substantially central position of suction port 21*a* in the circumferential direction, and which extends toward a spring receiving chamber 28 (described later). Near a boundary between introduction portion 23 and suction port 21*a*, there is formed a suction opening 21*b* which penetrates through end wall 11*a* of pump body 11, and which is opened to the outside. By this structure, the oil stored in an oil pan (not shown) of the internal combustion engine is sucked through suction opening 21*b* and suction port 21*a* into pump chambers PR which are located in the suction region, by a negative pressure generated in accordance with the pump operation of the pump constituting section. In this case, suction opening 21*a* and also introduction portion 23 are connected to a low pressure chamber 35 which is formed radially outside cam ring 15 in the suction region. Accordingly, the oil of the low pressure which is the suction pressure is also introduced into low pressure chamber 35.

Discharge port 22*a* includes a discharge opening 22*b* which is formed at a start end portion of discharge port 22*a*, which penetrates through end wall 11*a* of pump body 11, and which is opened to the outside. By this structure, the oil which is pressurized by the pump operation of the pump constituting section, and which is discharged into discharge port 22*a* is supplied from discharge opening 22*b* through a main oil gallery (not shown) that is formed inside the cylinder block, to sliding portions (not shown) of the engine, a valve timing control apparatus (not shown) and so on.

Moreover, discharge port 22*a* includes a connection groove 25*a* which is formed by cutting, and which connects discharge port 22*a* and bearing hole 11*b*. The oil is supplied through this connection groove 25*a* to bearing hole 11*b*. Furthermore, the oil is supplied to rotor 16 and side portions of vanes 17. With this, it is possible to ensure the good lubrication of the sliding portions. Besides, this connection groove 25*a* is formed so as not to be aligned with the projecting and retracting directions of vanes 17. With this, it is possible to suppress vanes 17 from falling into this connection groove 25*a* when vanes 17 are projected and retracted.

Figure 3:
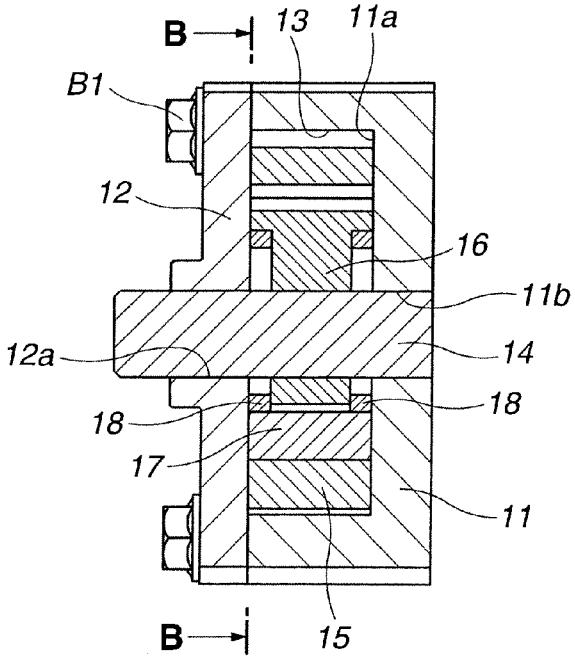
FIG. 3 is a sectional view taken along a section line A-A of FIG. 2.
Figure 6:
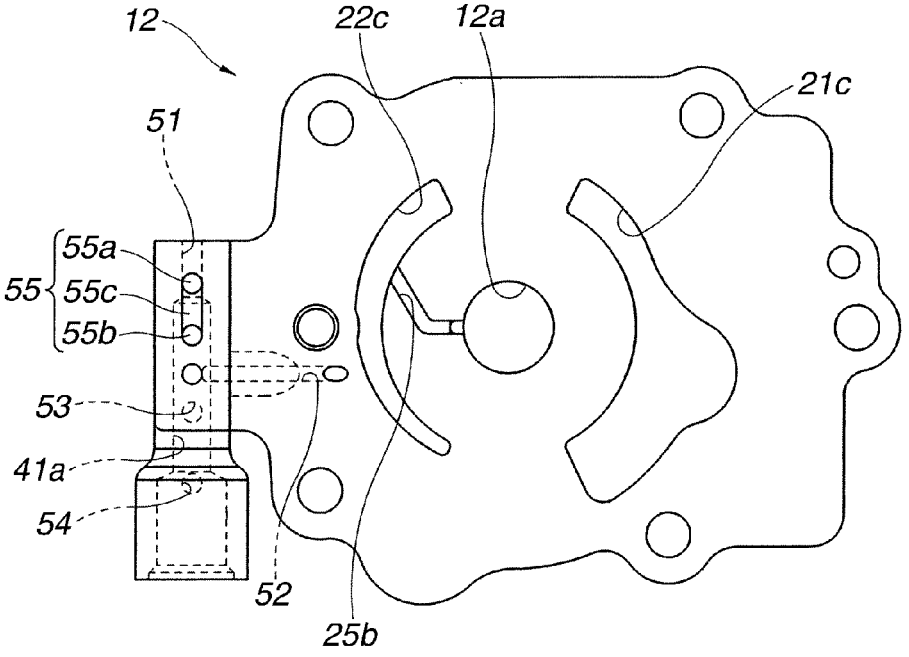
FIG. 6 is a view showing a cover member as viewed from the combined surface between the pump body and the cover member.

As shown in FIG. 3 and FIG. 6, cover member 12 has a substantially plate shape. Cover member 12 is mounted on the opening end surface of pump body 11 by a plurality of bolts B1. Cover member 12 includes a bearing hole 12*a* which is positioned at a position to confront bearing hole 11*b* of pump body 11, which penetrates through cover member 12, and which rotationally supports the other end side of drive shaft 14. Moreover, this cover member 12 includes a suction port 21*c*, a discharge port 22*c*, and a connection groove 25*b* which are formed on an inner side surface of cover member 12, like pump body 11. Suction port 21*c*, discharge port 22*c*, and connection groove 25*b* are disposed to confront suction port 21*a*, discharge port 22*a*, and connection groove 25*a* of pump body 11.

As shown in FIG. 3, drive shaft 14 includes the axial one end portion which penetrates through end wall 11*a* of pump body 11, which confronts the outside, and which is connected to the crank shaft and so on. Drive shaft 14 is arranged to rotate rotor 16 in a clockwise direction of FIG. 4 based on the rotational force transmitted from the crank shaft and so on. In this case, as shown in FIG. 4, a line N (hereinafter, referred to as a cam ring eccentric direction line) which passes through a center of drive shaft 14, and which is perpendicular to cam ring reference line M is a boundary between the suction region and the discharge region.

As shown in FIG. 1 and FIG. 4, rotor 16 includes the plurality of slits 16*a* which are formed by cutting from central side in the radially outward directions. Moreover, rotor 16 includes back pressure chambers 16*b* which have substantially circular cross section, and which are formed at radially inner base end portions of slits 16*a*, and which are arranged to receive the discharge hydraulic fluid. Vanes 17 are arranged to be pushed in the radially outward directions by a centrifugal force according to the rotation of rotor 16, and the pressures within back pressure chambers 16*b*.

Each of vanes 17 includes a tip end surface which is slidably abutted on the inner circumference surface of cam ring 15 at the rotation of rotor 16, and a base end surface which is slidably abutted on outer circumference surfaces of ring members 18 and 18. That is, vanes 17 are arranged to be pushed in the radially outward directions of rotor 16 by ring members 18 and 18. Accordingly, even when the engine speed is low, and the centrifugal force and the pressure of back pressure chambers 16*b* are small, the tip ends of vanes 17 are slidably abutted on the inner circumference surface of cam ring 15 so as to liquid-tightly separate pump chambers PR.

Cam ring 15 is integrally formed from sintered metal into a substantially cylindrical shape. Cam ring 15 includes a pivot portion 15*a* which is a substantially arc recessed groove, which is formed by cutting at a predetermined position of the outer circumference portion of cam ring 15 to extend in the axial direction, and in which pivot pin 19 is mounted to serve as an eccentric swing support point (fulcrum) about which cam ring 15 is swung; an arm portion 15*b* which is formed at a position opposite to pivot portion 15*a* with respect to the center of cam ring 15, which protrudes in the radial direction, and which is linked with a coil spring 33 which is an urging member having a predetermined spring constant. Besides, arm portion 15*b* includes a pressing protruding portion 15*c* which has a substantially arc raised shape, and which is formed on one side portion of arm portion 15*b* in the movement (pivot) direction. Pressing protruding portion 15*c* is constantly abutted on a tip end portion of coil spring 33 so that arm portion 15*b* and coil spring 33 are linked with each other.

Moreover, from the above-described structure, as shown in FIG. 4 and FIG. 5, pump body 11 includes a spring receiving chamber 26 which is formed inside pump body 11 at a position opposite to support groove 11*c*, which receives and holds coil spring 33, and which is formed at a position adjacent to pump receiving chamber 13 along cam ring eccentric direction line N of FIG. 4. Coil spring 33 having a predetermined set load W1 is elasitically disposed within spring receiving chamber 26 between one end wall of spring receiving chamber 26 and arm portion 15*b* (pressing protruding portion 15*c*). Besides, the other end wall of spring receiving chamber 26 is constituted as a restriction portion 28 arranged to restrict a range of the movement of cam ring 15 in the eccentric direction. The other side portion of arm portion 15*b* is abutted on restriction portion 28 so as to restrict a further rotation of cam ring 15 in the eccentric direction.

In this way, cam ring 15 is constantly urged by the urging force of coil spring 33 through arm portion 15*b* in a direction (in the clockwise direction in FIG. 4) in which the eccentric amount of cam ring 15 is increased. As shown in FIG. 4, in a non-actuation state, the other side portion of arm portion 15*b* is pressed on restriction portion 28, so that cam ring 15 is restricted at the position at which the eccentric amount of cam ring 15 is maximized.

Cam ring 15 includes a pair of first and second seal forming sections 15*e* and 15*f* which are formed at the outer circumference portion of cam ring 15 to protrude, and which have first and second seal surfaces 15*g* and 15*h* that confront first and second seal sliding surfaces 11*d* and 11*e* constituted by the inner circumference wall of pump body 11, and that have arc shapes which are concentric with seal sliding surfaces 11*d* and 11*e*. These seal surfaces 15*g* and 15*h* of seal constituting sections 15*e* and 15*f* include, respectively, seal holding grooves 15*i* which are formed by cutting to extend in the axial direction. First and second seal members 20*a* and 20*b* are received and held in these seal holding grooves 15*i*. First and second seal members 20*a* and 20*b* are arranged to be slidably abutted on seal sliding surfaces 11*d* and 11*e* at the eccentric swing movement of cam ring 15.

In this case, first and second seal surfaces 15*g* and 15*h* have, respectively, predetermined radii r1 and r2 which are slightly smaller than radii R1 and R2 of seal sliding surfaces 11*d* and 11*e*. Accordingly, there are minute clearances between these seal sliding surfaces 11*d* and 11*e*, and seal surfaces 15*g* and 15*h*. On the other hand, first and second seal members 20*a* and 20*b* are made, for example, from fluorine-based resin having a low frictional characteristic. Each of first and second seal members 20*a* and 20*b* has a linear elongated shape extending in the axial direction of cam ring 15. Seal members 20*a* and 20*b* are arranged to be pressed on seal sliding surfaces 11*d* and 11*e* by elastic forces of elastic members which are made from a rubber, and which are disposed on bottom portions of seal holding grooves 15*i*.

Moreover, there are formed a pair of first and second control hydraulic chambers 31 and 32 which are located radially outside cam ring 15, and which are separated by pivot pin 19, and first and second seal members 20*a* and 20*b*. Control hydraulic chambers 31 and 32 are arranged to receive the hydraulic pressure within the engine which corresponds to the pump discharge pressure, through a control pressure introduction passage 70 which is bifurcated from the main oil gallery. In particular, first control hydraulic chamber 31 is arranged to receive the pump discharge pressure through a first introduction passage 71 which is one of two branch passages bifurcated from control pressure introduction groove 70. On the other hand, second control hydraulic chamber 32 is arranged to receive the pump discharge pressure (hereinafter, referred to as second discharge pressure) which flows through second introduction passage 72 that is the other of the two branch passages, and pilot valve 40, and thereby whose pressure is decreased. Then, these hydraulic pressures are acted to pressure receiving surfaces 15*j* and 15*k* which are constituted by the outer circumference surfaces of cam ring 15 that confront first and second control hydraulic chambers 31 and 32, so that the movement force (the swing force) is applied to cam ring 15. In this case, in the pressure receiving surfaces 15*j* and 15*k*, first pressure receiving surface 15*j* has an area greater than an area of second pressure receiving surface 15*k*. Accordingly, when the same pressure is acted to both first pressure receiving surface 15*j* and second pressure receiving surface 15*k*, cam ring 15 is urged in a direction in which the eccentric amount of cam ring 15 is decreased (in the counterclockwise direction in FIG. 4).

By this configuration, in oil pump 10, when the urging force based on the internal pressures of first and second control hydraulic chambers 31 and 32 are smaller than the set load W1 of coil spring 33, cam ring 15 becomes the maximum eccentric state shown in FIG. 4. On the other hand, when the urging force based on the internal pressures of first and second control hydraulic chambers 31 and 32 becomes larger than set load W1 of coil spring 33 in accordance with the increase of the discharge pressure, cam ring 15 is moved in the concentric direction in accordance with the discharge pressure.

Figure 7:
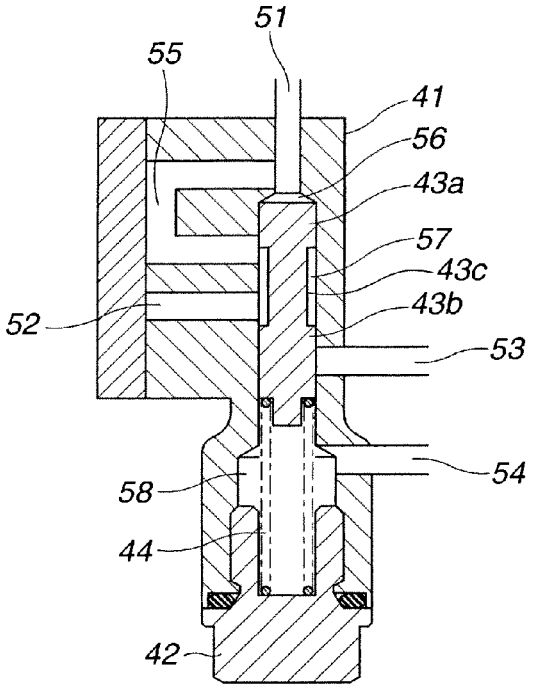
FIG. 7 is a sectional view taken along a section line C-C of FIG. 2.

As shown in FIG. 7, pilot valve 40 includes a substantially cylindrical valve body 41 (a control valve body) which includes a first axial end portion that is overlapped (connected) with cover member 12, and a second axial end portion that extends to the outside of cover member 12 to increase its diameter, and that includes an opening; a plug 42 which closes the opening of the second axial end portion of valve body 41; a spool valve element 43 (spool) which is received radially inside valve body 41 to be slid in the axial direction, which includes first and second land portions 43*a* and 43*b* that are a pair of large diameter portions slidably abutted on an inner circumference surface of valve body 41, and which is arranged to control to supply and discharge the hydraulic pressure to and from second control hydraulic chamber 32 by first and second land portions 43*a* and 43*b*; and a valve spring 44 which is elastically mounted radially inside the second end portion of valve body 41 between plug 42 and spool valve element 43 to have a predetermined set load W2, and arranged to constantly urge spool valve element 43 toward the first end portion side of valve body 41.

Valve body 41 includes a valve receiving portion 41*a* which is formed in a region other than the both end portions in the axial direction, which has a substantially constant inside diameter substantially identical to the outside diameter of spool valve element 43 (the outside diameters of first and second land portions 43*a* and 43*b*). Spool valve element 43 is disposed and received within valve receiving portion 41*a*. Moreover, valve body 41 includes an introduction port 51 which is formed in the small diameter first axial end portion of valve body 41, and which is an introduction passage opening portion connected to solenoid valve 60 through a passage 72*b* (hereinafter, referred to as a downstream side passage) which is a downstream portion of second introduction passage 72. On the other hand, valve body 41 includes an internal screw portion which is formed on an inner circumference surface of the large diameter second axial end portion of valve body 41, and in which plug 42 is screwed through the internal screw portion of the inner circumference portion.

Moreover, valve body 41 includes a supply and discharge port 52 which is formed in a circumferential wall of valve receiving portion 41*a*, which is opened at a substantially intermediate position in the axial direction, and which includes a first end portion connected to second control hydraulic chamber 32, and a second end portion constantly connected to a relay chamber 57 so that supply and discharge port 52 serves as a control hydraulic chamber opening portion arranged to supply and discharge the hydraulic pressure to and from second control hydraulic chamber 32. Furthermore, valve body 41 includes a first drain port 53 which is formed in the second axial end portion, which includes a first end portion directly opened to the outside or connected to the suction side, and which serves as a control drain opening portion arranged to discharge the hydraulic pressure within second control hydraulic chamber 32 through relay chamber 57 by switching the connection with relay chamber 57 (described later). Besides, valve body 41 includes a second drain port 54 which is formed to be opened in the circumference wall of the second axial end portion of valve body 41 at an axial position to be overlapped with a back pressure chamber 58 (described later) in the radial direction, and which is directly connected to the outside or connected to the suction side, like first drain port 53.

Moreover, valve body 41 includes a connection hydraulic passage 55 which is formed in the circumference wall of the first end side of valve body 41 by cooperating with pump body 11, and which is arranged to connect introduction port 51 and relay chamber 57 described later in a state in which spool valve element 43 is positioned at a position (cf. FIG. 4) on the upper end side in FIG. 7. That is, valve body 41 includes radial hydraulic passages 55*a* and 55*b* which are formed in the radial direction at predetermined axial positions, and which are arranged to be opened, respectively, to introduction port 51 and relay chamber 57 (described later) when spool valve element 43 is positioned in the predetermined region; and an axial hydraulic passage 55*c* which is formed into a groove shape on an inner side surface of cover member 12, and which serves as a hydraulic passage which connects radial hydraulic passages 55*a* and 55*b*, and which is located between cover member 12 and pump body 11 by jointing cover member 12 to pump body 11.

Spool valve element 43 includes first and second land portions 43*a* and 43*b* which are formed at both end portions in the axial direction; and a shaft portion 43*c* which is a small diameter portion formed between first and second land portions 43*a* and 43*b*. This spool valve element 43 is received within valve receiving portion 41*a*. With this, valve body 41 includes a pressure chamber 56 which is formed within valve body 41 on the axially outer side of first land portion 43*a* between the first end portion of valve body 41 and first land portion 43*a*, and to which the discharge pressure is introduced from introduction port 51; relay chamber 57 which is provided within valve body 41 between first and second land portions 43*a* and 43*b*, and which is arranged to relay (connect) supply and discharge port 52, and one of introduction port 51 (connection hydraulic passage 55) and first drain port 53 in accordance with the axial position of spool valve element 43; and back pressure chamber 58 within valve body 41 on the axially outer side of second land portion 43*b* between plug 42 and second land portion 43*b*, and which is arranged to discharge the oil leaked from relay chamber 57 through an outer circumference side (minute clearance) of second land portion 43*b*.

By this structure, when the discharge pressure introduced from introduction port 51 into pressure chamber 56 is equal to or smaller than a predetermined hydraulic pressure (a spool actuation hydraulic pressure Ps described later), spool valve element 43 of pilot valve 40 is positioned in a first region which is a predetermined region on the first end side of valve receiving portion 41*a*, by the urging force of valve spring 44 based on set load W2 (cf. FIG. 4). That is, when spool valve element 43 is positioned in the first region, introduction port 51 and relay chamber 57 are connected with each other through connection hydraulic passage 55, and first drain port 53 is disconnected from relay chamber 57 by second land portion 43*b*. Moreover, second control hydraulic chamber 32 and relay chamber 57 are connected through supply and discharge port 52. Accordingly, the hydraulic pressure introduced from introduction port 51 through connection hydraulic passage 55 is supplied through relay chamber 57 into second control hydraulic chamber 32.

Then, when the discharge pressure introduced into pressure chamber 56 becomes greater than a predetermined pressure, spool valve element 43 is moved from the first region toward the second end side of valve receiving portion 41*a* against the urging force of valve spring 44. Consequently, spool valve element 43 is positioned in a second region which is a predetermined region on the second end side of valve receiving portion 41*a* (cf. FIG. 10B). That is, when spool valve element 43 is positioned in the second region, second control hydraulic chamber 32 is continued to be connected to relay chamber 57 through supply and discharge port 52. On the other hand, connection hydraulic passage 55 is disconnected from relay chamber 57 by first land portion 43*a*. Moreover, relay chamber 57 is connected to an oil pan T and so on through first drain port 53. Consequently, the oil within second control hydraulic chamber 32 is discharged through relay chamber 57 and first drain port 53 to oil pan T and so on.

As shown in FIG. 4, solenoid valve 60 includes a substantially cylindrical valve body 61 (a switching valve body) which is disposed in a valve receiving hole (not shown) formed in second introduction passage 72, and which includes a hydraulic passage 65 that is formed within valve body 61 to penetrate through valve body 61 in the axial direction, and a valve element receiving portion 66 that is formed at one end portion (a left side end portion in FIG. 4) of valve body 61 by increasing the diameter of hydraulic passage 65; a seat member 62 which is fixed in an outer end portion of valve element receiving portion 66 by the press fit, and which includes an introduction port 67 that is formed at a central portion of seat member 62, and that is an upstream side opening portion connected to a passage 72*a* (hereinafter, referred to merely as an upstream side passage) which is an upstream portion of second introduction passage 72; a ball valve element 63 which is arranged to be seated on and unseated from a valve seat 62*a* formed on an edge of an opening of an inner end of seat member 62, and which is arranged to open and close introduction port 67; and a solenoid 64 which is provided to the other end portion (a right side end portion in FIG. 4) of valve body 61.

Valve body 61 includes valve element receiving portion 66 which is formed on the inner circumference portion of the one end portion of valve body 61, and which has a stepped shape whose a diameter is increased with respect to hydraulic passage 65. Moreover, valve element receiving portion 66 includes a valve seat 66*a* which is provided on an edge of an opening of an inner end of valve element receiving portion 66, and which is identical to valve seat 62*a* of seat member 62. Furthermore, valve body 61 includes a supply and discharge port 68 which is formed in the circumferential wall of valve body 61, radially outside valve element receiving portion 66 that is positioned on the one end portion side of valve body 61, which is formed in the radial direction to penetrate through valve body 61, and which is a downstream side opening portion arranged to be connected to downstream side passage 72*b*, and thereby to supply and discharge the hydraulic pressure to and from pilot valve 40. Moreover, valve body 61 includes a drain port 69 which is formed in the circumferential wall of valve body 61, radially outside hydraulic passage 65 that is positioned on the other end side of valve body 61, which is formed in the radial direction to penetrate through valve body 61, and which is a switching drain portion connected to a drain side such as an oil pan T.

Solenoid 64 is arranged to move an armature (not shown) disposed radially inside the coil, and a rod 64*b* fixed to the armature, in a forward direction (in a leftward direction in FIG. 4), by an electromagnetic force generated by the energization to the coil (not shown) received within a casing 64*a*. Besides, solenoid 64 receives an excitation current from an ECU (not shown) which is mounted on the vehicle, based on a driving state of the engine sensed or calculated by predetermined parameters such as the oil temperature and the water temperature of the internal combustion engine, and the engine speed.

By this construction, when solenoid 64 is energized, rod 64*b* is moved in the forward direction, ball valve element 63 disposed at the tip end portion of rod 64*b* is pressed on valve seat 62*a* of seat member 62, so that introduction port 67 and supply and discharge port 68 are disconnected from each other, and supply and discharge port 68 and drain port 69 are connected with each other through hydraulic passage 65. On the other hand, when solenoid 64 is deenergized, ball valve element 63 is moved in the rearward direction based on the discharge pressure introduced from introduction port 67, so that ball valve element 63 is pressed on valve seat 66*a* of valve body 61. Consequently, introduction port 67 and supply and discharge port 68 are connected with each other, and supply and discharge port 68 and drain port 69 are disconnected from each other.

Hereinafter, functions of oil pump 10 according to this embodiment of the present invention are illustrated with reference to FIG. 8 to FIG. 10.

First, a necessary hydraulic pressure (desired hydraulic pressure) of the internal combustion engine which is a reference of the discharge pressure control of oil pump 10 is illustrated with reference to FIG. 8 before the illustration of the functions of oil pump 10. A symbol P1 in FIG. 8 represents a first engine necessary hydraulic pressure corresponding to a necessary hydraulic pressure of a valve timing control apparatus arranged to improve the fuel consumption when the valve timing control apparatus is employed. A symbol P2 in FIG. 8 represents a second engine necessary hydraulic pressure corresponding to a necessary hydraulic pressure of an oil jet arranged to cool a piston when the oil jet is employed. A symbol P3 in FIG. 8 represents a third engine necessary hydraulic pressure necessary for lubrication of the bearing portions of the crank shaft at the high engine speed. A chain line connecting these points P1 to P3 represents an optimum necessary hydraulic pressure (discharge pressure) P according to the engine speed R of the internal combustion engine. Besides, a solid line in FIG. 8 represents a hydraulic pressure characteristic of oil pump 10 according to the embodiment of the present invention. A broken line represents a hydraulic pressure characteristic of a conventional pump.

Figure 8:
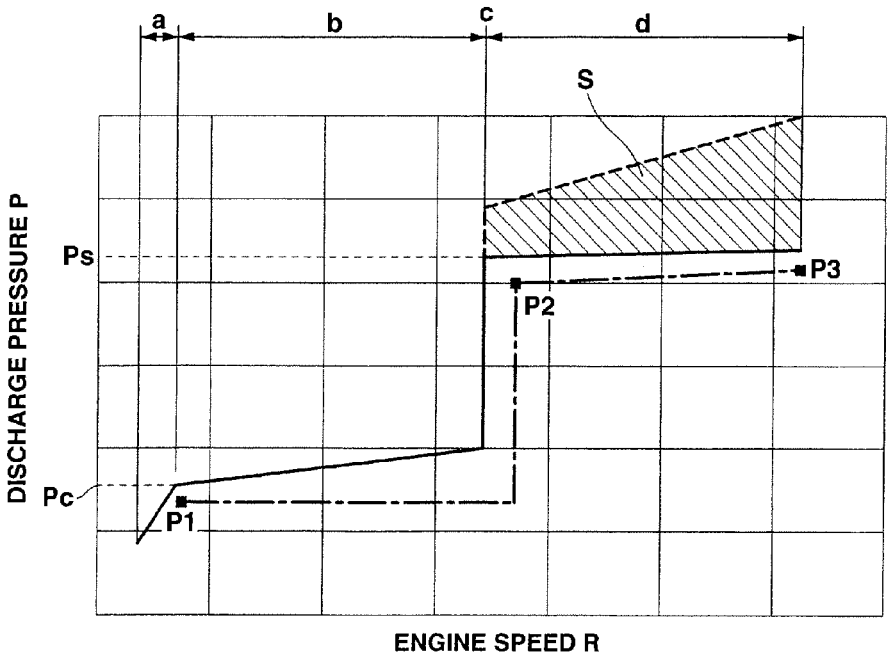
FIG. 8 is a graph showing a hydraulic pressure characteristic in the variable valve displacement pump of FIG. 1.
Figure 9A:
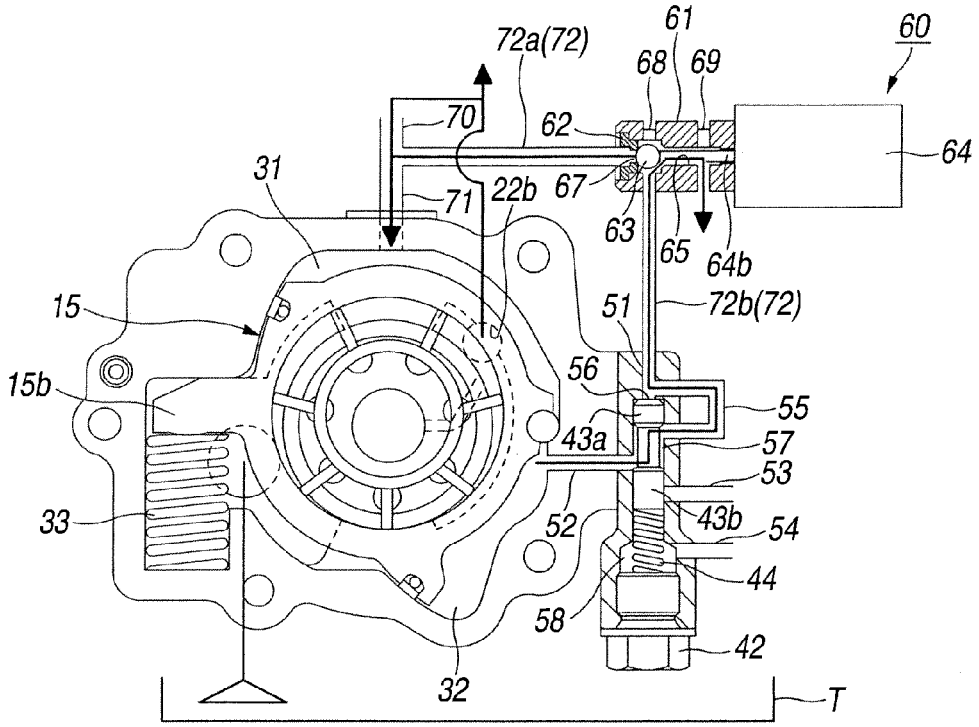
FIGS. 9A and 9B are views showing a hydraulic pressure circuit of the variable displacement pump of FIG. 1.

Moreover, a symbol Pc in FIG. 8 represents a cam ring actuation hydraulic pressure at which cam ring 15 is started to be moved in the concentric direction against the urging force of coil spring 33 based on set load W1. A symbol Ps in FIG. 8 represents a spool actuation hydraulic pressure at which spool valve element 43 is started to be moved from a first position to a second position against the urging force of valve spring 44 based on set load W2.

From this setting, in case of oil pump 10, in a section a in FIG. 8 which corresponds to the engine speed region from the start of the engine to the low engine speed, the excitation current is applied to solenoid 64. Accordingly, introduction port 67 and supply and discharge port 68 are disconnected from each other, and supply and discharge port 68 and drain port 69 are connected with each other. With this, discharge pressure P is not introduced into second control hydraulic chamber 32 (pilot valve 40). Spool valve element 43 of pilot valve 40 is positioned in the first region. Consequently, the oil within second control hydraulic chamber 32 is discharged from drain port 69 of solenoid valve 60 through downstream side passage 72*b* and hydraulic passage 65, and discharge pressure P is supplied only to first control hydraulic chamber 31. In this case, in this engine speed region, the discharge pressure (the hydraulic pressure within the engine) P is lower than cam ring actuation hydraulic pressure Pc. Accordingly, cam ring 15 is held in the maximum eccentric state, so that discharge pressure P is increased in substantially proportional to engine speed R (oil pump 10 becomes a characteristic by which discharge pressure P is increased in proportional to engine speed R).

Figure 9B:
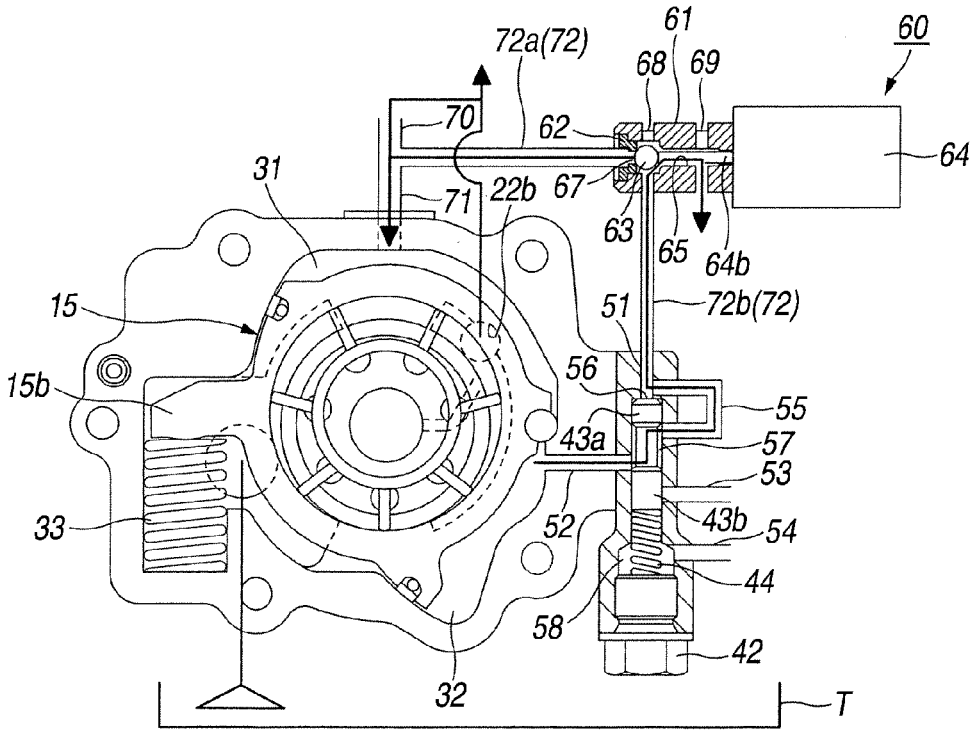

Then, when engine speed R is increased and discharge pressure P reaches cam ring actuation hydraulic pressure Pc (cf. FIG. 8), the energization state of solenoid 64 is maintained as shown in FIG. 9B. Accordingly, discharge pressure P is continuously supplied only to first control hydraulic chamber 31 as shown in FIG. 9B. With this, the urging force based on the internal pressure of first control hydraulic chamber 31 becomes greater than urging force W1 of coil spring 33, so that cam ring 15 is started to be moved in the concentric direction. Consequently, discharge pressure P is decreased, the increasing amount of discharge pressure P becomes small relative to the maximum eccentric state of cam ring 15 (a section b in FIG. 8).

Figure 10A:
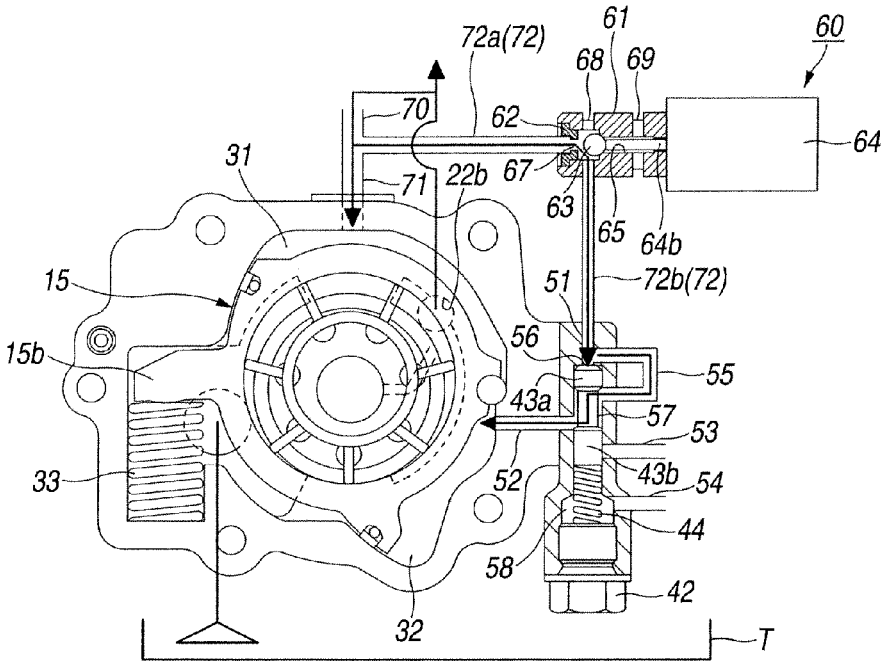
FIGS. 10A and 10B are views showing the hydraulic pressure circuit of the variable displacement pump of FIG. 1.

Next, when engine speed R is further increased and second engine necessary hydraulic pressure P2 is needed in the engine driving state (cf. FIG. 8), solenoid 64 is deenergized (the current to solenoid 64 is shut off). Accordingly, as shown in FIG. 10A, introduction port 67 and supply and discharge port 68 are connected with each other, and supply and discharge port 68 and drain port 69 are disconnected from each other. Consequently, discharge pressure P introduced from upstream side passage 72*a* is introduced through downstream side passage 72*b* to the pilot valve 40's side. At this time, discharge pressure P does not reach spool actuation hydraulic pressure Ps. Accordingly, spool valve element 43 of pilot valve 40 is positioned in the first region. Consequently, introduction port 51 and supply and discharge port 52 are connected through connection hydraulic passage 55. Moreover, first drain port 53 is closed by second land portion 43*b*. The opening (lower side opening in FIG. 10) of connection hydraulic passage 55 on the valve receiving portion 41*a*'s side and first land portion 43*a* are overlapped with each other, so that a throttling is formed by decreasing an area of the opening of connection hydraulic passage 55 between connection hydraulic passage 55 and valve receiving portion 41*a*. Accordingly, the second discharge pressure which is slightly decreased by passing through this throttling is supplied to second control hydraulic chamber 32. With this, the urging force in the eccentric direction which is the resultant force of urging force W1 of coil spring 33 and the urging force based on the internal pressure of second control hydraulic chamber 32 becomes greater than the urging force in the concentric direction which is based on the internal pressure of first control hydraulic chamber 31. Consequently, cam ring 15 is pressed in the returned direction which is the eccentric direction, so that the increase amount of discharge pressure P becomes large again (a timing c in FIG. 8).

Figure 10B:
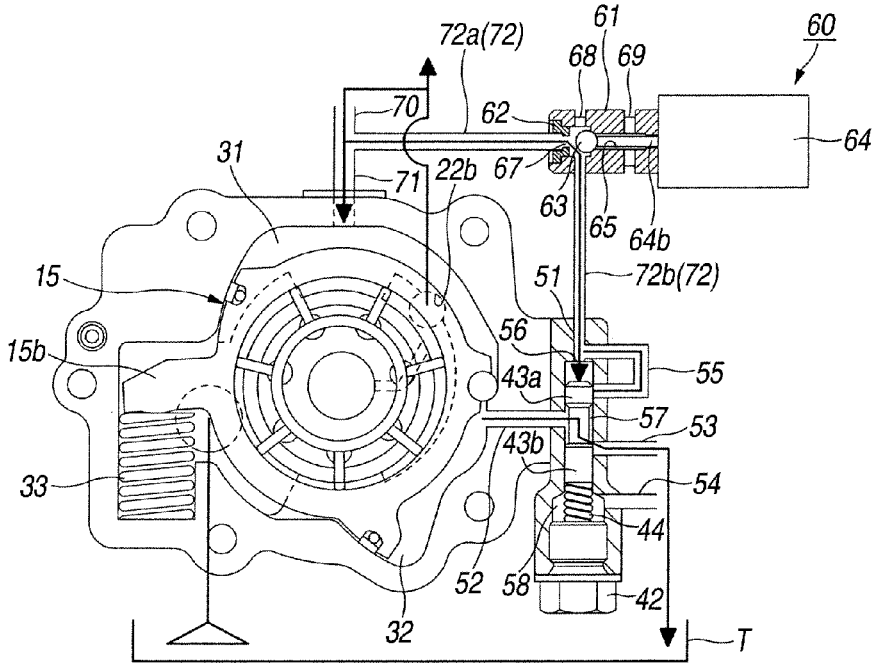

Then, when discharge pressure P is increased based on this pressure increase characteristic and discharge pressure P becomes equal to spool actuation hydraulic pressure Ps (cf. FIG. 8), spool valve element 43 of pilot valve 40 is moved toward plug 42 against urging force W2 of valve spring 44 based on discharge pressure P introduced from introduction port 51 to pressure chamber 56, as shown in FIG. 10B. Accordingly, the position of spool valve element 43 is switched from the first region to the second region. With this, the opening of connection hydraulic passage 55 on the valve receiving portion 41*a*'s side is closed by first land portion 43*a*, and supply and discharge port 52 and first drain port 53 are connected with each other through relay chamber 57. Accordingly, the oil within second control hydraulic chamber 32 is discharged, and discharge pressure P is supplied only to first control hydraulic chamber 31. Consequently, the urging force in the concentric direction which is based on the internal pressure of first pressure control chamber 31 becomes greater than the urging force in the eccentric direction which is the resultant force of the urging force W1 of coil spring 33 and the urging force based on the internal pressure of second control hydraulic chamber 32, and cam ring 15 is moved in the concentric direction, so that the discharge pressure P is decreased.

Then, when the hydraulic pressure (discharge pressure P) acted to the one end of spool valve element 43 becomes smaller than spool actuation hydraulic pressure Ps by the decrease of discharge pressure P, urging force W2 of valve spring 44 becomes greater than the urging force by discharge pressure P, as shown in FIG. 10A, so that spool valve element 43 is moved toward introduction port 51. With this, introduction port 51 of pilot valve 40 and supply and discharge port 52 are connected with each other, so that the second discharge pressure is again supplied to second control hydraulic chamber 32. Consequently, cam ring 15 is pressed and returned in the eccentric direction, so that discharge pressure P is increased again. Then, when the hydraulic pressure acted to the one end of spool valve element 43 becomes greater than spool actuation hydraulic pressure Ps by this increase of discharge pressure P, spool valve element 43 is again moved to the second region against urging force W2 of valve spring 44 as shown in FIG. 10B. With this, the oil within second control hydraulic chamber 32 is discharged as described above, and discharge pressure P is supplied only to first control hydraulic chamber 31. Accordingly, the urging force based on the internal pressure of first control hydraulic chamber 32 in the concentric direction becomes greater than the urging force in the eccentric direction which is the resultant force of urging force W1 of coil spring 33 and the urging force based on the internal pressure of second control hydraulic chamber 32. Consequently, cam ring 15 is moved in the concentric direction, so that discharge pressure P is decreased again.

In this way, in oil pump 10, spool valve element 43 of pilot valve 40 continuously switches the connection between supply and discharge port 52 connected to second control hydraulic chamber 32, and introduction port 51 or first drain port 53. With this, discharge pressure P is adjusted to be held to spool actuation hydraulic pressure Ps. In this case, this pressure regulation (adjustment) is performed by the switching of supply and discharge port 52 of pilot valve 40. Accordingly, the pressure regulation is not influenced by the spring constant of coil spring 33. Moreover, the pressure regulation is performed in an extremely small region of the movement of spool valve element 43 of valve spring 44. Consequently, in this section d in FIG. 8, discharge pressure P of oil pump 10 is not increased in proportional to the increase of engine speed R like the conventional pump shown by the broken line in FIG. 8. In this section d in FIG. 8, discharge pressure P of oil pump 10 has a substantially flat characteristic in which discharge pressure P of oil pump 10 is not increased in proportional to the increase of engine speed R. Accordingly, it is possible to bring discharge pressure P of oil pump 10 closer to optimum necessary hydraulic pressure (the chain line in FIG. 8). With this, in oil pump 10 according to the embodiment of the present invention, it is possible to reduce the power loss (a region shown by a hatching S in FIG. 8) which is generated by increasing discharge pressure P unnecessary, relative to the conventional oil pump in which discharge pressure P is forced to be increased in accordance with the increase of the engine speed R, by the amount of the spring constant of coil spring 33.

In oil pump 10 according to this embodiment of the present invention, it is possible to hold discharge pressure P to the predetermined pressure in the engine speed region (section d in FIG. 8) in which the pressure is needed to be held to the predetermined pressure (spool actuation hydraulic pressure Ps) at least higher than second engine necessary hydraulic pressure P2, based on the pressure regulation control by pilot valve 40.

That is, in oil pump 10 according to the embodiment of the present invention, when discharge pressure P exceeds spool actuation hydraulic pressure Ps from a state in which discharge pressure P is greater than cam ring actuation hydraulic pressure Pc, and equal to or smaller than spool actuation hydraulic pressure Ps which is the predetermined pressure, spool valve element 43 is moved from the first region to the second region. By this movement of spool valve 43, the eccentric amount of cam ring 15 is decreased. Accordingly, discharge pressure P becomes smaller than spool actuation hydraulic pressure Ps again, so that spool valve element 43 is returned to the first region. This switching of the connection of supply and discharge port 52 by spool valve element 43 is repeated. With this, it is possible to hold discharge pressure P to spool actuation hydraulic pressure Ps, as shown in FIG. 8.

This pressure regulation is performed by pilot valve 40. Accordingly, the pressure regulation is not influenced by the spring constant of coil spring 33. Moreover, in pilot valve 40, the pressure regulation is performed in the extremely small region of the movement of spool valve element 43. Consequently, the pressure regulation is also not influenced by the spring constant of valve spring 44. That is, it is possible to maintain to the desired discharge pressure without causing the problems that discharge pressure P is unnecessarily increased by the influence of the spring constant of coil spring 33, and also valve spring 44.

Moreover, in the variable displacement pump according to this embodiment of the present invention, solenoid valve 60 is disposed in second introduction passage 72. The timing of the introduction of discharge pressure P to pilot valve 40's side is controlled by the switching control of the opening and the closing by solenoid valve 60. Accordingly, it is possible to hold to the desired discharge pressure by the switching of the connection of supply and discharge port 52 of pilot valve 40 at a desired timing at which the predetermined pressure (spool actuation hydraulic pressure Ps) is needed.

That is, in a case of a structure in which discharge pressure P is equally introduced into first control hydraulic chamber 31 and second control hydraulic chamber 32 (pilot valve 40) without using solenoid valve 60, in particular in the high engine speed region (relatively high engine speed region), spool valve element 43 is started to be moved from the first region to the second region based on this high engine speed, before the predetermined pressure is needed. Accordingly, discharge pressure P is decreased at the timing at which the predetermined pressure is needed. Consequently, there is generated the problems that the predetermined pressure cannot be ensured. In the variable displacement pump according to the embodiment of the present invention, it is possible to avoid this problems.

The present invention is not limited to the structure according to the embodiment. For example, engine necessary hydraulic pressures P1-P3, cam ring actuation hydraulic pressure Pc, and spool actuation hydraulic pressure Ps may be freely varied in accordance with specifications of the internal combustion engine of the vehicle to which oil pump 10 is mounted, the valve timing control apparatus and so on.

Moreover, in the variable displacement pump according to the embodiment of the present invention, the discharge pressure is varied by swinging cam ring 15. The structure arranged to vary the discharge amount is not limited to the structure by the swinging movement. For example, the discharge pressure may be varied by linearly moving cam ring 15 in the radial direction. That is, manner of the movement of cam ring 15 is not limited as long as it is the structure in which the discharge amount can be varied.

Furthermore, in the variable displacement pump according to the embodiment of the present invention, ball valve element 63 is employed as the valve element of the switching mechanism. However, for example, a spool may be used as the valve element of the switching mechanism, in addition to the ball valve element 63. That is, any valve elements can be used as the valve element of the switching mechanism as long as it can switch the connections of ports 67, 68, and 69.

Moreover, in variable displacement pump according to the embodiment of the present invention, the variable displacement pump is the variable displacement vane pump. Accordingly, the movable member is cam ring 15. The variable mechanism is constituted by cam ring 15 which is swingably moved, control hydraulic chambers 31 and 32 disposed radially outside cam ring 15, and coil spring 33. However, in a case in which the present invention is applied to other variable displacement pump such as trochoid pump, an outer rotor constituting an external gear corresponds to the movable member. The outer rotor is disposed to be eccentric like cam ring 15, and the control hydraulic chambers and the spring are disposed radially outside the outer rotor, so that the variable mechanism is constituted.

(a) In the variable displacement pump according to the embodiment of the present invention, the switching mechanism is an electromagnetic control valve arranged to be electrically controlled to be switched.

(b) In the variable displacement pump according to the embodiment of the present invention, the hydraulic fluid discharged from the discharge portion is used for a lubrication of an internal combustion engine.

(c) In the variable displacement pump according to the embodiment of the present invention, the hydraulic fluid discharged from the discharge portion is used as a driving source of a variable valve actuating device, and for an oil jet arranged to supply the hydraulic fluid to a piston of the internal combustion engine.

(d) In the variable displacement pump according to the embodiment of the present invention, the control mechanism includes a throttling which is constituted by the spool and the control valve body.

(e) In the variable displacement pump according to the embodiment of the present invention, the downstream side opening portion and the switching drain opening portion are formed in an circumferential wall of the switching valve body.

(f) In the variable displacement pump according to the embodiment of the present invention, the control drain opening portion and the control hydraulic chamber opening portion are formed in a circumferential wall of the control valve body.

The entire contents of Japanese Patent Application No. 2012-258826 filed Nov. 27, 2012 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement pump comprising:

a housing including a pump receiving chamber formed within the housing;

a rotor which is disposed within the pump receiving chamber, and which is rotationally driven;

a plurality of vanes which are provided on an outer circumference side of the rotor to be projectable from and retractable into the rotor;

a cam ring which is received within the pump receiving chamber, which receives the rotor and the plurality of vanes therein, which separates a portion between the rotor and an inner circumference side of the cam ring to a plurality of hydraulic fluid chambers, and which is arranged to be moved so that a center of an inner circumference of the cam ring is eccentric with respect to a center of the rotation of the rotor so as to vary an eccentric amount of the center of the inner circumference of the cam ring with respect to the center of the rotation of the rotor;

side walls disposed on both sides of the cam ring in the axial direction, at least one of the side walls including a suction portion opened in a part of the plurality of the hydraulic fluid chambers, and a discharge portion opened in another part of the plurality of the hydraulic fluid chambers;

a coil spring which is a first urging member, which is provided within the pump receiving chamber to have a set load, and which is arranged to urge the cam ring in a direction in which the eccentric amount of the cam ring is increased;

a first control hydraulic chamber which is formed between the pump receiving chamber and the cam ring, to which a hydraulic fluid discharged from the discharge portion is introduced, and whose volume is increased when the cam ring is moved against an urging force of the coil spring;

a second control hydraulic chamber which is formed between the pump receiving chamber and the cam ring, to which the hydraulic fluid discharged from the discharge portion is introduced from the discharge portion through an introduction passage, and whose volume is increased when the cam ring is moved in a direction identical to a direction of the urging force of the coil spring;

a switch which is provided in the introduction passage, and which is arranged to a switch a first state in which a flow of the hydraulic fluid from the introduction passage to the second control hydraulic chamber is shut off, and in which the hydraulic fluid within the second control hydraulic chamber is discharged, and a second state in which the hydraulic fluid introduced from the introduction passage is introduced into the second control hydraulic chamber; and an actuatable control which is provided in the introduction passage between the switch and the second control hydraulic chamber, which is arranged to be actuated based on a hydraulic pressure introduced into the first control hydraulic chamber before the eccentric amount is minimized, and which is arranged to introduce the hydraulic pressure to the second control hydraulic chamber when the hydraulic pressure introduced from the introduction passage through the switch is equal to or smaller than a predetermined pressure, and to discharge the hydraulic fluid within the second control hydraulic chamber in accordance with the hydraulic pressure when the hydraulic pressure introduced from the introduction passage through the switch becomes greater than the predetermined pressure.

2. The variable displacement pump as claimed in claim 1, wherein the switch is an electromagnetic control valve arranged to be electrically controlled.

3. The variable displacement pump as claimed in claim 1, wherein the hydraulic fluid discharged from the discharge portion is used for a lubrication of an internal combustion engine.

4. A variable displacement pump comprising:

a housing including a pump receiving chamber formed within the housing;

a rotor which is disposed within the pump receiving chamber, and which is rotationally driven;

a plurality of vanes which are provided on an outer circumference side of the rotor to be projectable from and retractable into the rotor;

a cam ring which is received within the pump receiving chamber, which receives the rotor and the plurality of vanes therein, which separates a portion between the rotor and an inner circumference side of the cam ring to a plurality of hydraulic fluid chambers, and which is arranged to be moved so that a center of an inner circumference of the cam ring is eccentric with respect to a center of the rotation of the rotor so as to vary an eccentric amount of the center of the inner circumference of the cam ring with respect to the center of the rotation of the rotor;

side walls disposed on both sides of the cam ring in the axial direction, at least one of the side walls including a suction portion opened in a part of the plurality of the hydraulic fluid chambers, and a discharge portion opened in another part of the plurality of the hydraulic fluid chambers;

a coil spring which is a first urging member, which is provided within the pump receiving chamber to have a set load, and which is arranged to urge the cam ring in a direction in which the eccentric amount of the cam ring is increased;

a first control hydraulic chamber which is formed between the pump receiving chamber and the cam ring, to which a hydraulic fluid discharged from the discharge portion is introduced, and whose volume is increased when the cam ring is moved against an urging force of the coil spring;

a second control hydraulic chamber which is formed between the pump receiving chamber and the cam ring, to which the hydraulic fluid discharged from the discharge portion is introduced from the discharge portion through an introduction passage, and whose volume is increased when the cam ring is moved in a direction identical to a direction of the urging force of the coil spring;

a switching mechanism which is provided in the introduction passage, the switching mechanism including:

a switching valve body including an upstream side opening portion which is connected to a portion of the introduction passage that is on a side of the discharge portion, a downstream side opening portion which is connected to a portion of the introduction passage that is on the second control hydraulic chamber, and a switching drain opening portion serving as a drain, a valve element which is received within the switching valve body, and which is arranged to switch a connection state between the upstream side opening portion, the downstream side opening portion and the switching drain opening portion, and a solenoid which is arranged to drive the valve element by being applied with an current; and a control mechanism including:

a control valve body including an introduction passage opening portion which is opened in the downstream side opening portion, a control drain opening portion connected to the drain, and a control hydraulic chamber opening portion connected to the second control hydraulic chamber, a spool which is slidably received within the control valve body, and which is arranged to switch a connection state between the introduction passage opening portion, the control drain opening portion, and the control hydraulic chamber opening portion in accordance with an axial position of the spool, and a valve spring which is a second urging member which is received within the second axial end portion of the control valve body, and which is arranged to urge the spool toward the first axial end portion of the control valve body.

5. The variable displacement pump as claimed in claim 4, wherein the control mechanism includes a throttling which is constituted by the spool and the control valve body.

6. The variable displacement pump as claimed in claim 4, wherein the downstream side opening portion and the upstream side opening portion are formed in an circumferential wall of the switching valve body.

7. The variable displacement pump as claimed in claim 4, wherein the control drain opening portion and the control hydraulic chamber opening portion are formed in a circumferential wall of the control valve body.

8. A variable displacement pump comprising:

a housing including a pump receiving chamber formed within the housing;

a pump constituting section which includes a rotor rotationally driven, and a plurality of vanes that are provided on an outer circumference side of the rotor to be projectable from and retractable into the rotor, which is arranged to vary volumes of a plurality of hydraulic fluid chambers in accordance with a rotation, and which is arranged to be rotationally driven, and thereby to discharge a hydraulic fluid introduced from a suction portion to a discharge portion;

a cam ring which is received within the pump receiving chamber, which receives the pump constituting section on an inner circumference side of the cam ring, which separates a portion between the rotor and the inner circumference side of the cam ring by the plurality of the vanes, and which is arranged to be moved so that a center of an inner circumference of the cam ring is eccentric with respect to a center of the rotation of the rotor so as to vary an eccentric amount of the center of the inner circumference of the cam ring with respect to the center of the rotation of the rotor;

a coil spring which is a first urging member which is provided within the pump receiving chamber to have a set load, and which is arranged to urge the cam ring in a direction in which the variation amounts of the volumes of the hydraulic fluid chambers opened to the discharge portion are increased;

a first control hydraulic chamber which is formed between the pump receiving chamber and the cam ring, to which the hydraulic fluid discharged from the discharge portion is introduced, and whose volume is increased when the cam ring is moved against an urging force of the coil spring;

a second control hydraulic chamber which is formed between the pump receiving chamber and the cam ring, to which the hydraulic pressure discharged from the discharge portion is introduced through an introduction passage connected to the discharge portion, and whose volume is increased when the cam ring is moved in a direction identical to a direction of the urging force of the coil spring;

a switching valve which is provided in the introduction passage, and which is arranged to switch a first state in which a flow of the hydraulic fluid from the introduction passage to the second control hydraulic chamber is shut off, and in which the hydraulic fluid within the second control hydraulic chamber is discharged, and a second state in which the hydraulic fluid introduced from the introduction passage is introduced into the second control hydraulic chamber; and a control valve which is provided in the introduction passage between the switching valve and the second control hydraulic chamber, which is arranged to be actuated based on the hydraulic pressure introduced into the first control hydraulic chamber before the variation amounts of the volumes of the hydraulic fluid chambers become minimized by the cam ring, and which is arranged to introduce the hydraulic pressure to the second control hydraulic chamber when the hydraulic pressure introduced from the introduction passage through the switching valve is equal to or smaller than a predetermined pressure, and to discharge the hydraulic fluid within the second control hydraulic chamber in accordance with the hydraulic pressure when the hydraulic pressure introduced from the introduction passage becomes greater than the predetermined pressure.

* * * * *